US012371827B2

(12) United States Patent
Yam et al.

(10) Patent No.: US 12,371,827 B2
(45) Date of Patent: Jul. 29, 2025

(54) CONTROL COMMAND GENERATION METHODS AND SYSTEMS FOR THREE-DIMENSIONAL SURFACE WEAVING

(71) Applicant: Centre for Perceptual and Interactive Intelligence (CPII) Limited, Hong Kong (HK)

(72) Inventors: Yeung Yam, Hong Kong (HK); Xiangjia Chen, Hong Kong (HK); Man Lip Lai, Hong Kong (HK); Changling Charlie Wang, Cheshire (GB); Man Tai Andy Wong, Hong Kong (HK)

(73) Assignee: Centre for Perceptual and Interactive Intelligence (CPII) Limited, Hong Kong (HK)

( * ) Notice: Subject to any disclaimer, the term of this patent is extended or adjusted under 35 U.S.C. 154(b) by 112 days.

(21) Appl. No.: 18/371,007

(22) Filed: Sep. 21, 2023

(65) Prior Publication Data

US 2024/0102214 A1 Mar. 28, 2024

(30) Foreign Application Priority Data

Sep. 26, 2022 (HK) ..... 22022061212.5

(51) Int. Cl.
*D03D 41/00* (2006.01)
*D03D 25/00* (2006.01)

(52) U.S. Cl.
CPC ..... *D03D 41/004* (2013.01); *D03D 25/005* (2013.01)

(58) Field of Classification Search
CPC .... D03D 41/004; D03D 25/005; D03D 41/00; G06F 19/00
USPC ..... 700/130–135, 140
See application file for complete search history.

(56) References Cited

U.S. PATENT DOCUMENTS 6,185,475 B1 * 2/2001 Chung ..... G06T 11/001 700/133
7,272,244 B2 * 9/2007 Saporiti ..... D03C 19/005 700/131
8,050,791 B2 * 11/2011 Li ..... D03C 19/00 700/133
8,600,541 B2 * 12/2013 Shan ..... B33Y 10/00 700/131
9,103,054 B2 * 8/2015 Shan ..... D03D 25/005
11,692,287 B2 * 7/2023 Shan ..... D03D 41/004 139/212

(Continued)

*Primary Examiner* — Danny Worrell
(74) *Attorney, Agent, or Firm* — Rivka Friedman

(57) ABSTRACT

The present application relates to control command generation methods and systems for three-dimensional surface weaving. The control command generation method comprises the steps of: rebuilding a desired three-dimensional object into a three-dimensional surface mesh; converting the three-dimensional surface mesh into readable weaving information; and generating control commands from the readable weaving information to instruct a three-dimensional surface weaving system. The control command generation method generally comprises a pipeline of software including the mesh processing, weaving map extraction and command generation. The control command generation method can enable three-dimensional surface weaving function.

10 Claims, 25 Drawing Sheets

(56) References Cited

U.S. PATENT DOCUMENTS

| | | | | |
|---|---|---|---|---|
| 2013/0073074 | A1* | 3/2013 | Shan | D04H 3/05 700/131 |
| 2018/0264740 | A1* | 9/2018 | Ohnishi | B29C 64/393 |
| 2023/0230227 | A1* | 7/2023 | Schneider-Die-Gross | G06T 5/20 382/111 |
| 2024/0076886 | A1* | 3/2024 | Wang | B28B 1/001 |
| 2024/0102213 | A1* | 3/2024 | Yam | D03D 41/004 |
| 2024/0102214 | A1* | 3/2024 | Yam | D03D 41/004 |
| 2024/0240370 | A1* | 7/2024 | Oberste | D03D 41/004 |
| 2024/0384522 | A1* | 11/2024 | Van Egmond | E04B 1/19 |
| 2025/0069333 | A1* | 2/2025 | Cantero Clares | G06T 5/70 |

* cited by examiner

| | | | | |
|---|---|---|---|---|
| | | | | |
| | | | | |
| | | | | |
| −3 | | | | −2 |
| −2 | | | | −1 |
| −3 | −1 | | 0 | −2 |
| −2 | 0 | | | −1 |
| −1 | | | | 0 |
| 0 | | | | |
| | | | | |

FIG. 18

A
B1006100610061006100610061006
C010101
DR
B1006100610061006100610061006
C001010
DL
B1006100610061006100610061006
C010100
DR
B1006100610061006100610061006
C001010
DL
B1006100610061006100610061006
C000100
DR
B0012001200120012001200120012
C001000
DL
B1006100610061006100610061006
C010100
DR
B0024002410001000000240024
C101010
DL
B1006100610061006100610061006
C010101
DR
B1006100610061006100610061006
C101010
DL
E

FIG. 22

CONTROL COMMAND GENERATION METHODS AND SYSTEMS FOR THREE-DIMENSIONAL SURFACE WEAVING

TECHNICAL FIELD

The present disclosure relates to a field of the textile industry, and in particular to control command generation methods and systems for three-dimensional surface weaving.

BACKGROUND

Any discussion of the prior art throughout the specification should in no way be considered as an admission that such prior art is widely known or forms part of common general knowledge in the field.

Weaving is one of humanity's oldest technologies, which is related to clothes, architecture, and aerospace industry. The interweaving of warps and wefts produces a plain fabric which is hard to deform in the directions of warp thread and weft thread.

In 1804, Joseph Marie Jacquard invented a weaving machine with a jacquard loom which made possible the automatic production of varieties of complex pattern weaving. The weave pattern can set the appearance of fabric, including, e.g., matte velvet, shiny satin, and vibrant multicolor patterns; change the feel of the fabric, from, e.g., rough plain weave to fuzzy terry. The state-of-the-art weaving machine enables the weaving of thousands of heddles with computer-controlled and complex weave patterns due to the electronic version of the jacquard loom. Almost all of the existing weaving machines are designed to weave plain fabric no matter what different materials or complex patterns they apply.

Although there are some hand-woven products with 3D surfaces in our life, e.g., woven rattan chairs, the production process still cannot be automated and industrialized until a weaving machine with a 3D surface weaving function is made.

On the other hand, knitting, as another branch of ancient textile technology, has made huge progress in terms of 3D forming in recent decades. The latest research shows that it is possible to seamlessly knit a garment based on a 3D human model using a state-of-the-art knitting machine. However, there is a limitation in the material due to the structure of knitting knot, the material has to be soft and elastic, e.g., cotton. The knitting fabric shows isotropic properties and poor mechanical properties while being applied tensile force compared with weaving fabric.

Therefore, what is needed are techniques that overcome the above-mentioned disadvantages.

SUMMARY

According to various embodiments of the present disclosure, control command generation methods and systems for three-dimensional surface weaving are provided.

A control command generation method for three-dimensional surface weaving, the method comprising steps of:

- rebuilding a desired three-dimensional object into a three-dimensional surface mesh;
- converting the three-dimensional surface mesh into readable weaving information; and
- generating control commands from the readable weaving information to instruct a three-dimensional surface weaving system.

A control command generation system for three-dimensional surface weaving comprising:

- a processor; and
- a non-transitory computer readable medium connected to the processor and having stored thereon instructions for causing the processor to:
- rebuild a desired three-dimensional object into a three-dimensional surface mesh;
- convert the three-dimensional surface mesh into readable weaving information; and
- generate control commands from the readable weaving information to instruct a three-dimensional surface weaving system.

Details of one or more embodiments of the present disclosure will be given in the following description and attached drawings. Other features, objects and advantages of the present disclosure will become apparent from the description, drawings, and claims.

BRIEF DESCRIPTION OF THE DRAWINGS

In order to better describe and illustrate the embodiments and/or examples of the contents disclosed herein, reference may be made to one or more drawings. Additional details or examples used to describe the drawings should not be considered as limiting the scope of any of the disclosed contents, the currently described embodiments and/or examples, and the best mode of these contents currently understood.

FIG. 18 illustrates a diagram for weaving map C of the desired three-dimensional object shown in FIG. 15, according to an embodiment of the present disclosure;

FIG. 22 illustrates a diagram for an embodiment of codes of the control and shown in FIG. 21;

DETAILED DESCRIPTION OF THE EMBODIMENTS

Figure 1:
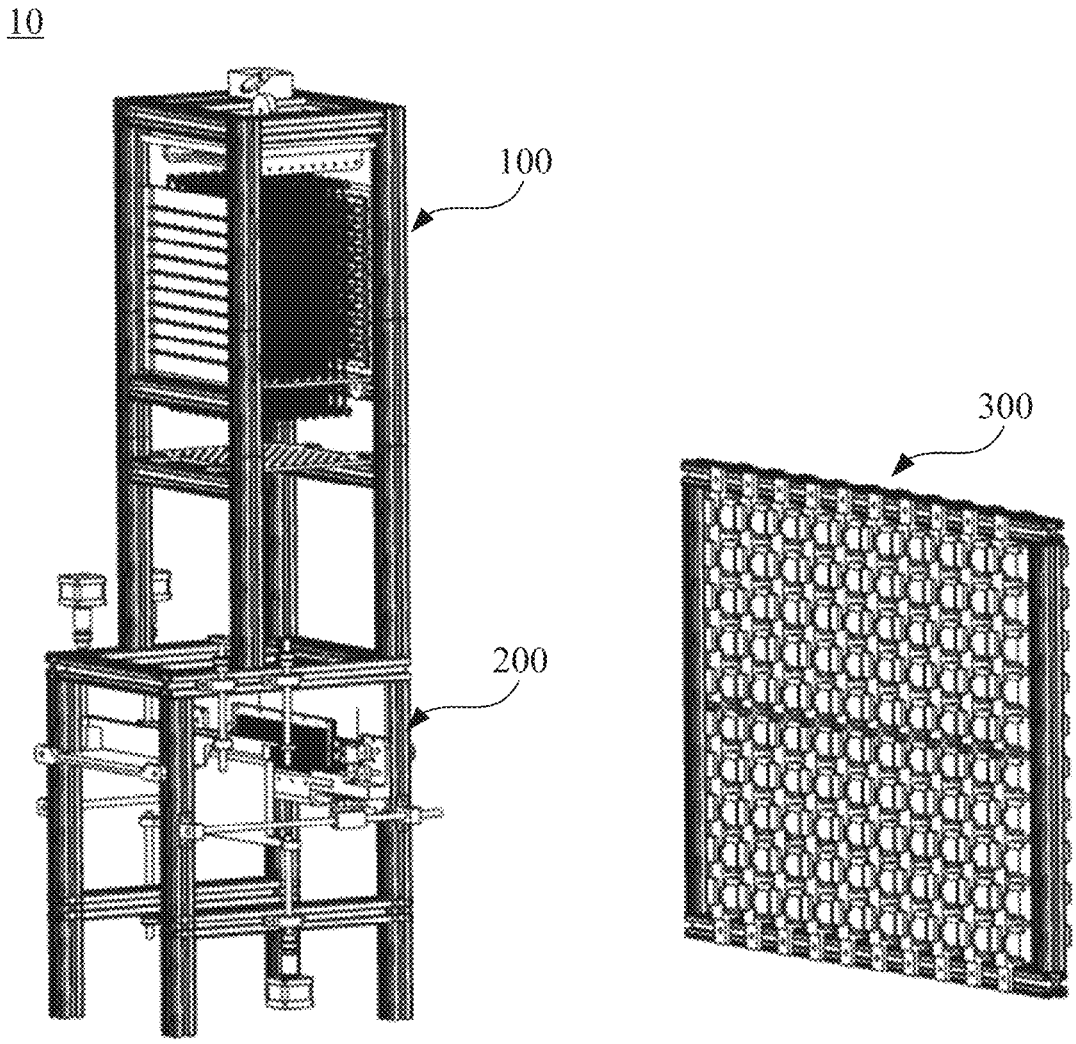
FIG. 1 illustrates a system for three-dimensional surface weaving, according to an embodiment of the present disclosure.

In order to facilitate the understanding of the present disclosure, the present disclosure will be described more fully below with reference to the relevant drawings. Preferred embodiments of the present disclosure are shown in the drawings. However, the present disclosure can be implemented in many different forms and is not limited to the embodiments described herein. On the contrary, the purpose of providing these embodiments is to make the disclosure of the present disclosure more thorough and comprehensive.

Unless otherwise defined, all technical and scientific: terms used herein have the same meaning as commonly understood by one of ordinary skill in the art to which this invention belongs. The definitions are provided to aid in describing particular embodiments, and are not intended to limit the claimed invention. The term "and/or" used herein includes any and all combinations of one or more related listed items.

In order to understand this application thoroughly, detailed steps and structures will be provided in the description below to explain the technical solution proposed by this application. Preferred embodiments of this application are described in detail below. However, in addition to these details, there may be other embodiments of this application.

It should be noted that when an element is referred to as being "fixed to" another element, it can be directly on another element or an intervening element may also be present there between. When an element is considered to be "connected to" another element, it can be directly connected to another element or an intervening element may be present at the same time. Terms "inner", "outer" "upper", "lower", "left", "right" and similar expressions used herein are for illustrative purposes only, and do not mean that they are the only embodiments.

Referring to FIG. 1, a control command generation method for three-dimensional surface weaving is used to generate control commands that operate the system 10 for three-dimensional surface weaving. The system 10 comprises a jacquard device 100, a weaving device 200 and a roller matrix 300. The system 10 is configured to weave fabric with a three-dimensional surface by using warp threads and weft threads and enables 3D surface weaving function automatically.

Figure 2:
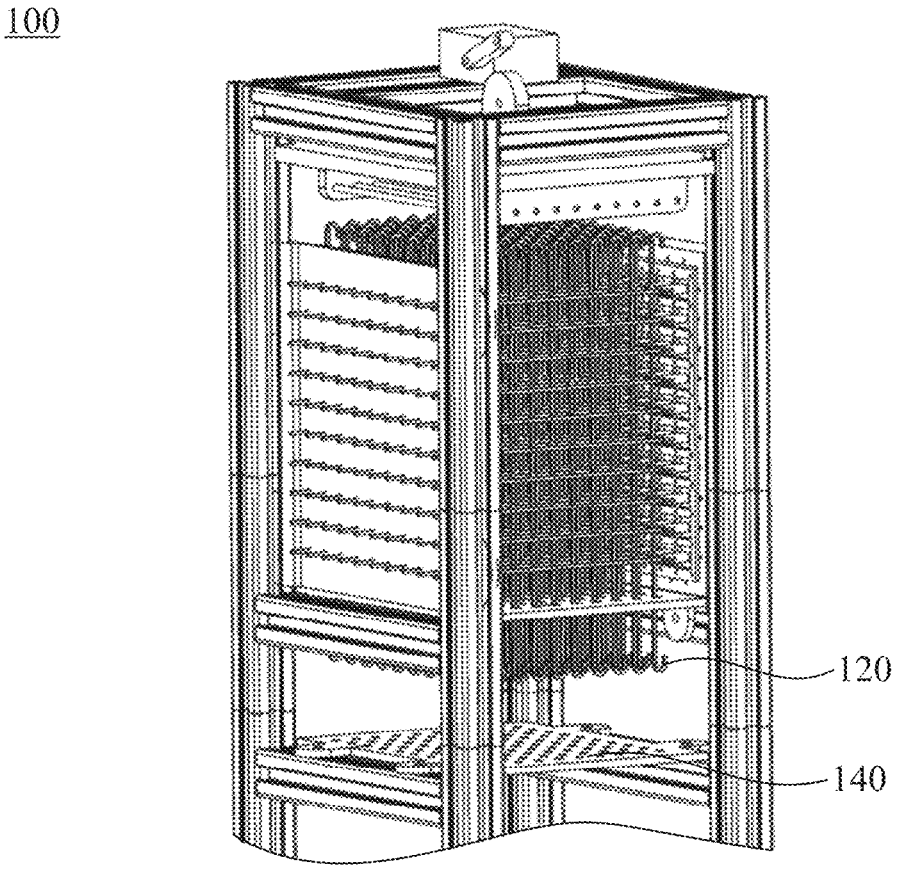
FIG. 2 illustrates a jacquard device of the system shown in FIG. 1.

Referring to FIG. 2, the jacquard device 100 is configured to selectively raise or lower the warp threads to form a shed for the weft thread to travel. The shed is a gap allowing the weft thread to interlace. In some embodiments, the jacquard device 100 can be located directly above the weaving device 200. The jacquard device 100 can be a full jacquard device 100. The jacquard device 100 can include heddles 120 and a rectification board 140. The heddles 120 can be controlled by computer programs to selectively raise or lower the warp threads. The heddles 120 go through the rectification board 140. The rectification board 140 can unify the lifting direction and magnitude for all selected heddles 120 when the jacquard device 100 is working. The warp threads and heddles 120 are perpendicular to the same horizontal line where there are rings tied on the heddles 120 so that the warp threads can form a shed as the heddles 120 selectively raise or lower under the control of the jacquard device 100.

Figure 3:
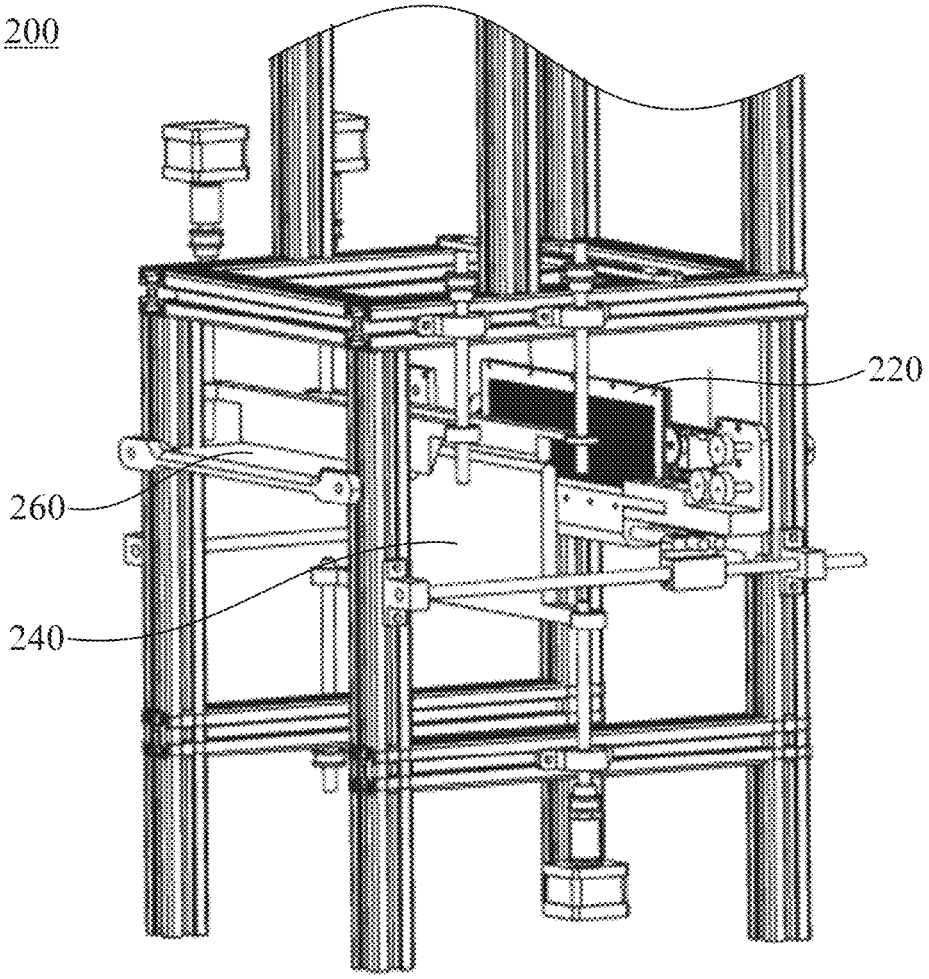
FIG. 3 illustrates a weaving device of the system shown in FIG. 1.

Referring to FIG. 3, the weaving device 200 is configured to carry the weft thread into the shed and weave the weft thread on the warp threads. The weaving device 200 comprises a reed 220 and a shuttle (not shown in FIG. 3), the shuttle is movable along the reed 220 and configured to carry the weft thread. The heddles 120 drawn from the jacquard device 100 dive into the weaving device 200 to control the warp threads. The heddles 120 selectively raise or lower the warp threads to form the shed, then the shuttle carries the weft thread into the shed. After that, the reed 220 moves to interlace the weft thread with the warp threads.

Figure 4:
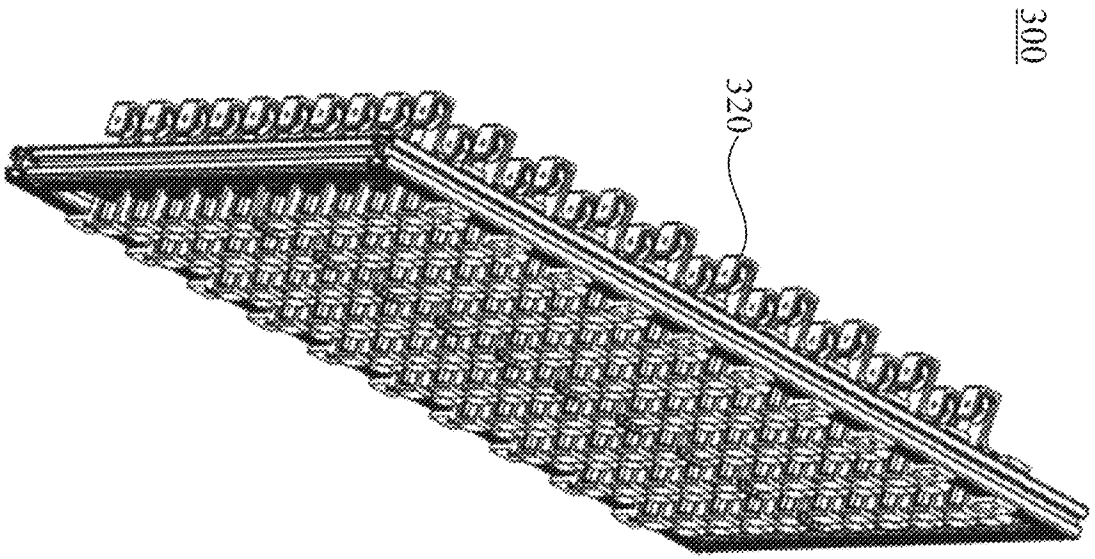
FIG. 4 illustrates a roller matrix of the system shown in FIG. 1.

Referring to FIG. 4, the roller matrix 300 is configured to control the warp threads to move forward or backward. The roller matrix 300 is mainly responsible for sending or collecting warp threads individually. The roller matrix 300 includes individually controlled rotate apparatus 320. In some embodiments, one rotate apparatus 320 controls one of the warp threads to move forward or backward.

Figure 5:
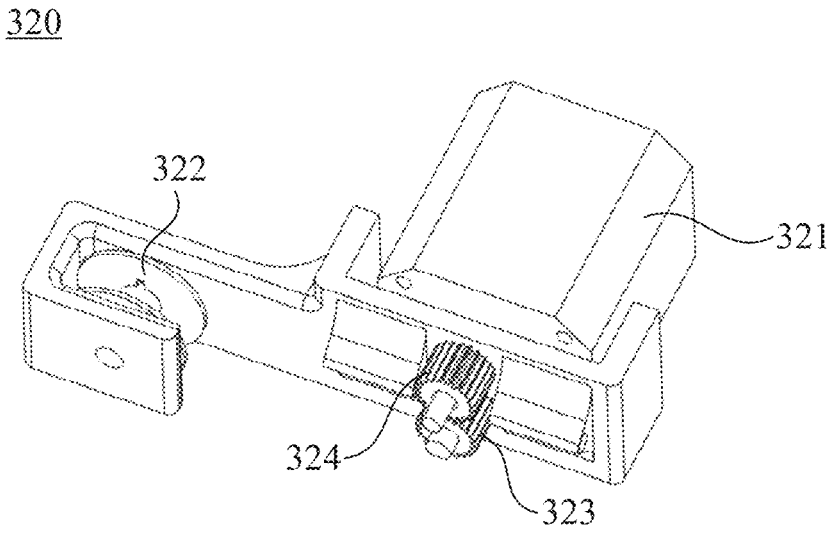
FIG. 5 illustrates a rotate apparatus of the roller matrix shown in FIG. 4.

Referring to FIG. 5, the rotate apparatus 320 can be driven by a step motor 321, the step motor 321 is configured to drive the warp thread forward or backward. In an embodiment, the rotate apparatus 320 can further comprise a coil 322, a driving gear 323 and a driven gear 324. The coil 322 is configured to coil 322 the warp thread. The driving gear 323 is driven by the step motor 321. The driving gear 323 meshes with the driven gear 324, and driving gear 323 and the driven gear 324 are configured to clamp the warp thread to move forward or backward. The warp thread is released from the coil 322 and goes through a positioning hole to a position between the driving gear 323 and the driven gear 324. The driving gear 323 is driven by the step motor 321 which could rotate forward or inverse. The driving gear 323 meshes with driven gear 324, so the warp thread is clamped inside. As the driving gear 323 rotates, the warp thread will be sent or collected to realize individually controlling function.

The warp threads come from rotate apparatus 320 installed on the roller matrix 300. The rotate apparatus 320 is controlled individually to forward or reverse rotate according to W-code converted from a three-dimensional surface, so that the attached warp thread is able to be longer or shorter. As the warp threads can be shortened during weaving process, the three-dimensional surface can be produced. Compared with handmade three-dimensional surface weaving, the system 10 enables 3D surface weaving function automatically. Compared with three-dimensional knitting fabric, the three-dimensional weaving products of the system 10 shows good mechanical properties.

Figure 6:
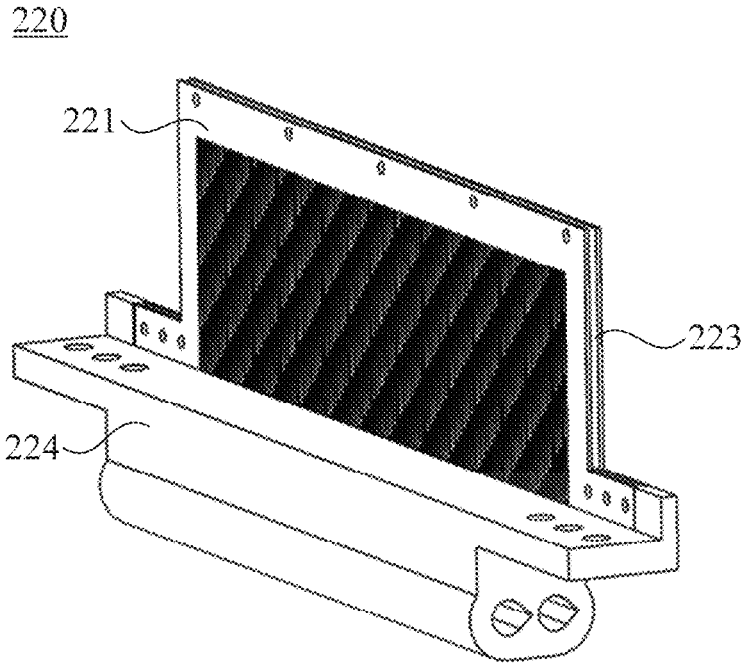
FIG. 6 illustrates a reed of the weaving device shown in FIG. 3.
Figure 7:
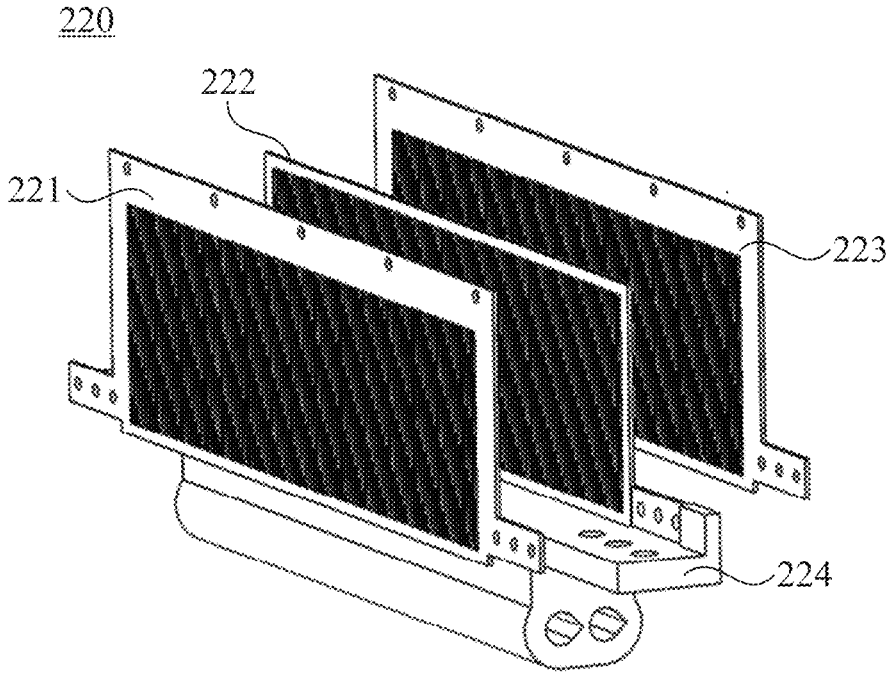
FIG. 7 illustrates an exploded view of the reed shown in FIG. 6.

In some embodiments, the weaving device 200 can be also improved. Referring to FIGS. 6-7, in this embodiment, the reed 220 includes a first slice 221, a second slice 222, a third slice 223 and a basement 224; the first slice 221 and the third slice 223 are fixed on the basement 224; the second slice 222 is placed between the first slice 221 and the third slice 223. The second slice 222 is movable to clamp or unclamp the warp threads. In an embodiment, the second slice 222 has freedom of left and right movement. The three-piece reed 220 moves along the direction of warp threads. In an embodiment, the first slice 221, the second slice 222 and the third slice 223 are grid slices. All the slices have strip holes and when the second slice 222 moves to a specific position, the strip holes of these slices are passable for warp threads. Instead, when the second slice 222 moves a little bit from the specific position, the passages close and the warp threads are clamped.

Figure 8:
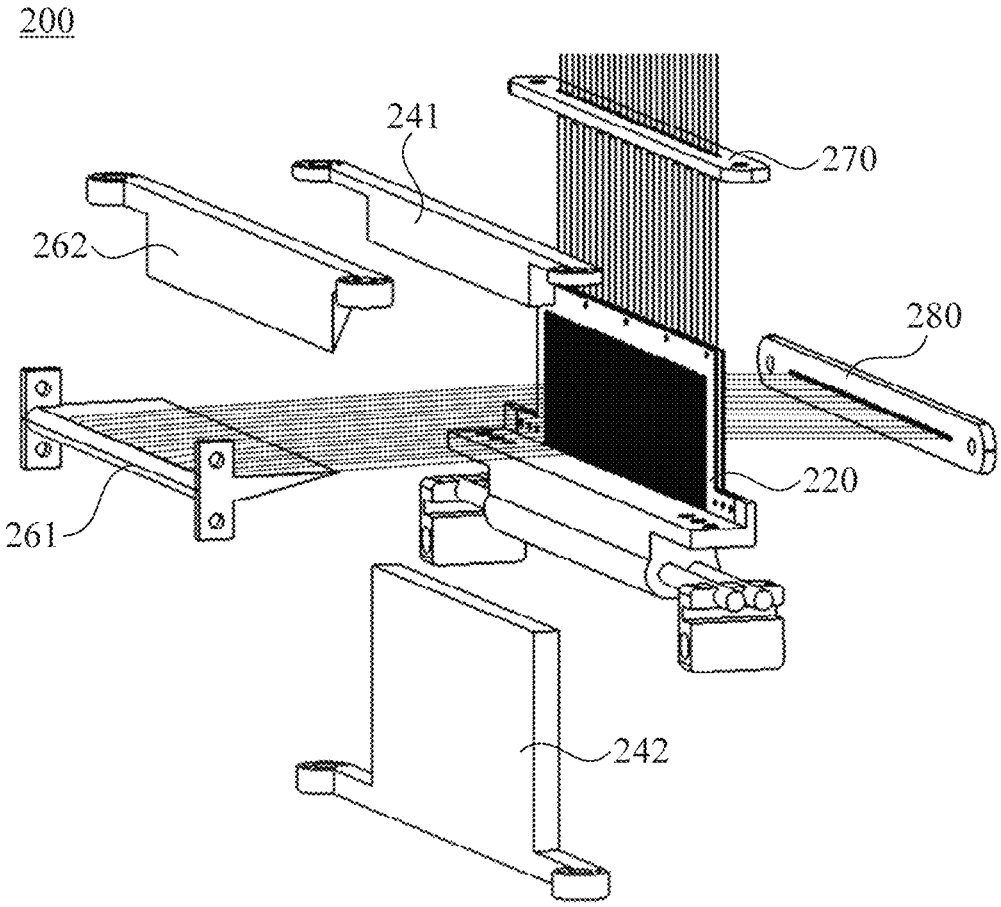
FIG. 8 illustrates a schematic diagram of the weaving device shown in FIG. 3.
Figure 9:
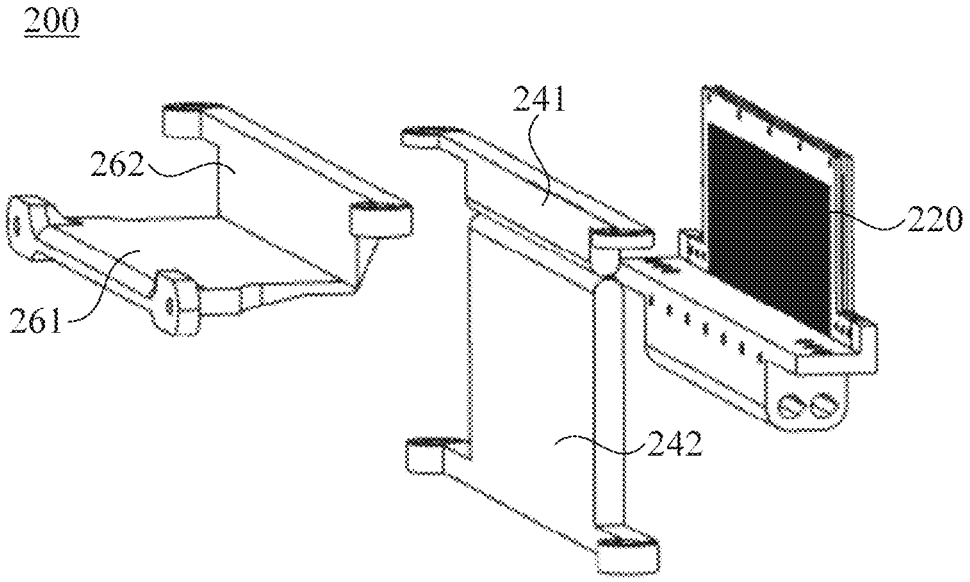
FIG. 9 illustrates another schematic diagram of the weaving device shown in FIG. 3.

Further, referring to FIGS. 3, 8 and 9, in some embodiments, the weaving device 200 further includes a gate 240 located in middle of the weaving device 200; the gate 240 is configured to open to let the reed 220 pass or close to make the warp threads at same height. The gate 240 can include a first gate part 241 and a corresponding second gate part 242. In this embodiment, the first gate part 241 and second gate part 242 can move vertically. When the gate 240 is open, the reed 220 can pass. When the gate 240 is closed, the first gate part 241 and second gate part 242 can clamp the warp threads to make all the warp threads at same height.

In some embodiments, the weaving device 200 can further comprise a collection apparatus 260. The collection apparatus 260 includes of a platform 261 and a movable clamping piece 262, the clamping piece 262 is configured to press finished fabric on the platform 261. To prevent the finished fabric from slipping, the clamping piece 262 will press the finished fabric on the platform 261 until the new weft is interlaced.

Figure 10:
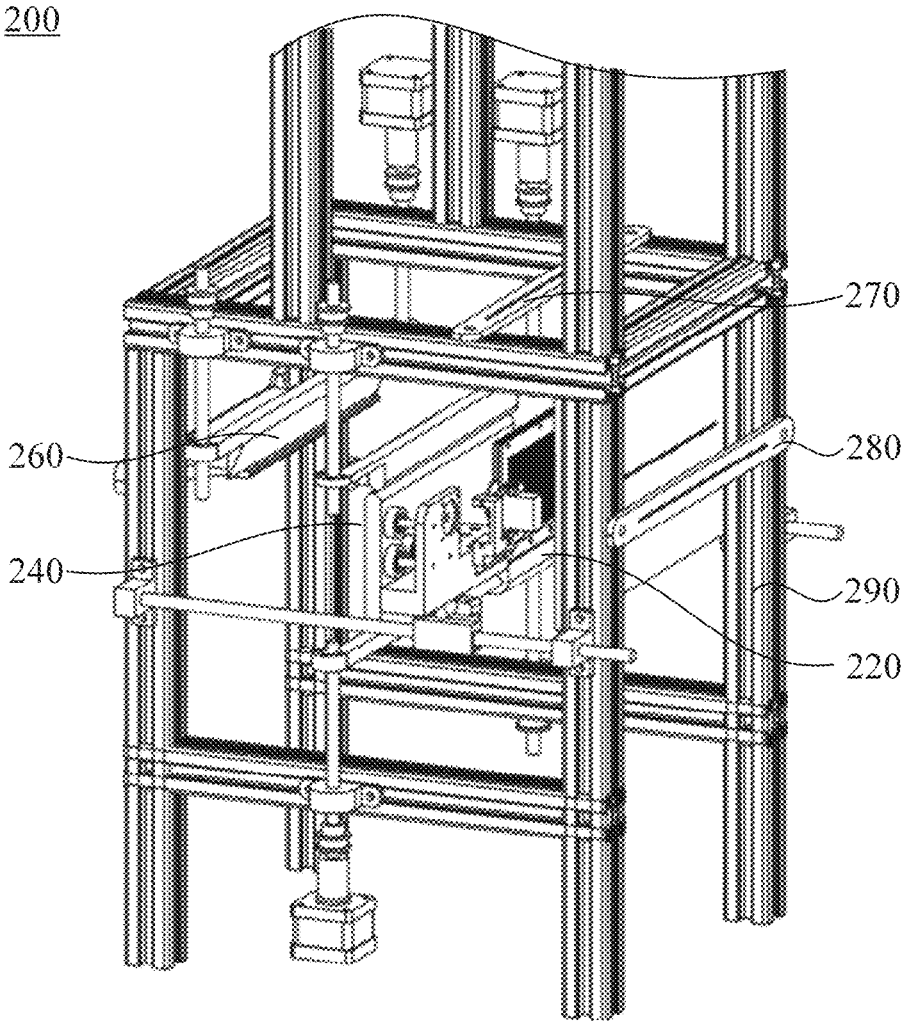
FIG. 10 illustrates another view of the weaving device shown in FIG. 3.
Figure 11:
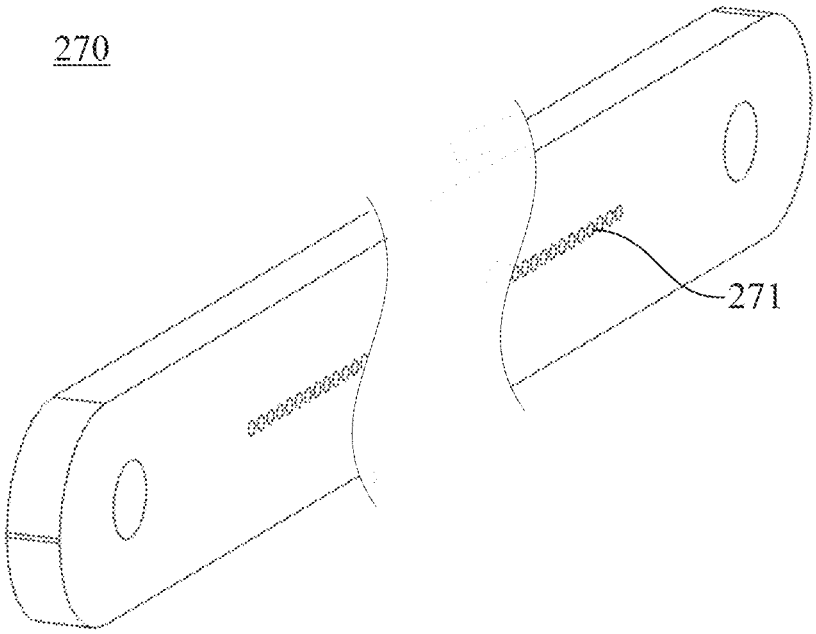
FIG. 11 illustrates a heddle hole board of the weaving device shown in FIG. 3.

Referring to FIGS. 10-11, in some embodiments, the weaving device 200 can comprise a heddle hole board 270. The heddle hole board 270 is provided with a row of heddle holes 271. The heddles 120 go through the rectification board 140, and then go through the row of the heddle holes 271 to connect the warp threads. In some embodiments, the weaving device 200 can comprise a warp hole board 280. The structure of the warp hole board 280 is similar to heddle hole board 270. The warp hole board 280 is provided with a row of warp holes. The warp threads from the roller matrix 300 go through the row of the warp holes.

The weaving device 200 also includes a gantry 290. In this embodiment, the reed 220, the gate 240, the collection apparatus 260, the heddle hole board 270 and the warp hole board 280 are mounted on the gantry 290. The movement of the reed 220, the gate 240 and the collection apparatus 260 can be driven by motors and lead screws.

Figure 12:
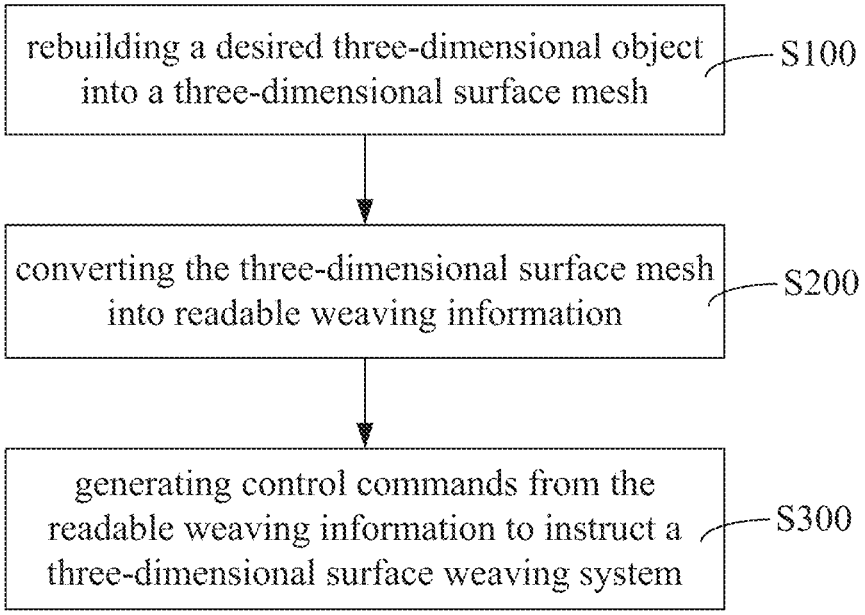
FIG. 12 illustrates a flowchart for a control command generation method for three-dimensional surface weaving, according to an embodiment of the present disclosure.

Referring to FIG. 12, the control command generation method for three-dimensional surface weaving generates control commands and corresponding operations realized on the system 10. The control command generation method comprises steps of:

- S100: rebuilding a desired three-dimensional object into a three-dimensional surface mesh;
- S200: converting the three-dimensional surface mesh into readable weaving information; and
- S300: generating control commands from the readable weaving information to instruct a three-dimensional surface weaving system.

The control command generation method generally comprises a pipeline of software including the mesh processing, weaving map extraction and command generation. The control command generation method can enable three-dimensional surface weaving function that overcomes the shortcomings of the prior art weaving method and knitting method.

The step S100 provides a mesh processing strategy to rebuild the desired 3D mesh into the three-dimensional surface mesh. The desired 3D mesh is an input of this method, and the three-dimensional surface mesh is an available mesh for the following processes. In an embodiment, each unit of the three-dimensional surface mesh is the same size so that the weaving information can be extracted. The step of S200 provides a weaving map extraction method. To satisfy constraint of the system 10, the weaving information will be converted to a weaving map which is between-row continuous and readable for the jacquard device 100. In the step of S300, with the weaving map, the final w-code can be generated to instruct the system 10 with corresponding operations.

Figure 13:
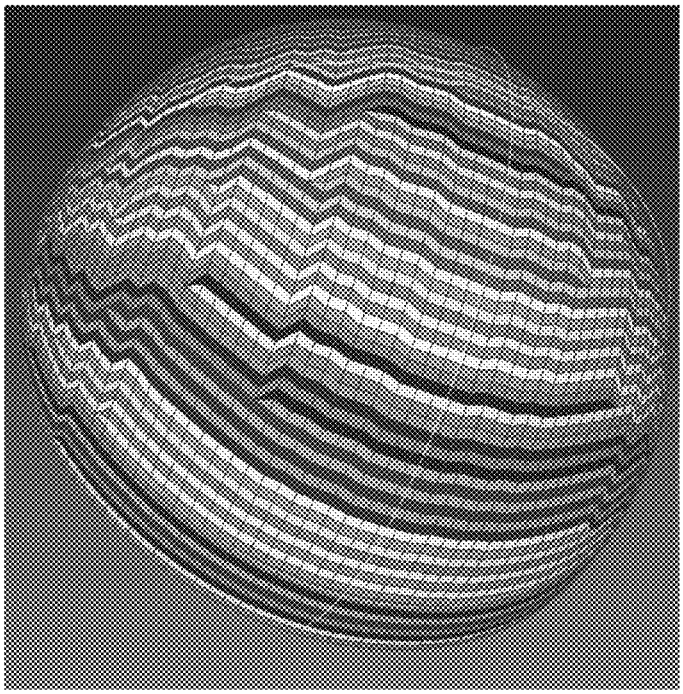
FIG. 13 illustrates a diagram for an embodiment of the three-dimensional surface mesh of the control command generation method shown in FIG. 12.

In some embodiments, referring to FIG. 13, the S100 concretely comprises the step of getting the three-dimensional surface mesh with uniform units over a surface of the desired three-dimensional object; a length of each unit is equal to a gap between neighboring warp threads, a width of each unit is equal to a gap between neighboring weft threads. The shape of the unit can be a rectangle, triangle, or parallelogram. Triangle units are allowed in the convergence region, where there will be a short row for deformation.

Figure 14:
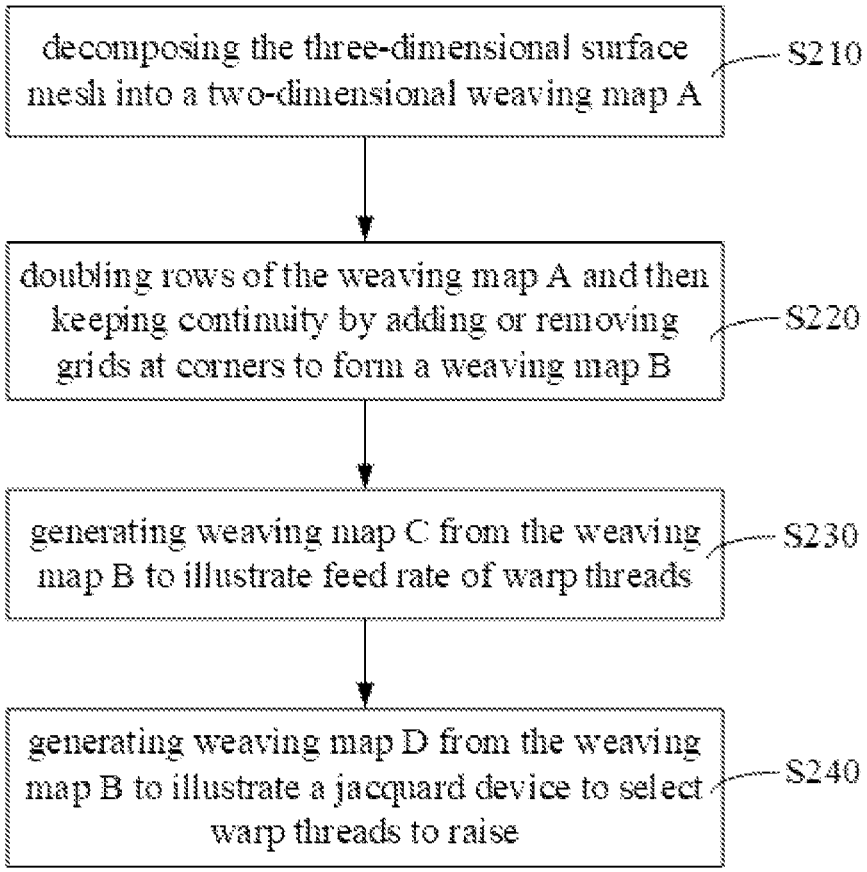
FIG. 14 illustrates a flowchart for an embodiment of step S200 of the control command generation method shown in FIG. 12.

In some embodiments, referring to FIG. 14, the step of S200 comprises the following steps:

- S210: decomposing the three-dimensional surface mesh into a two-dimensional weaving map A;
- S220: doubling rows of the weaving map A and then keeping continuity by adding or removing grids at corners to form a weaving map B;
- S230: generating weaving map C from the weaving map B to illustrate feed rate of warp threads; and
- S240: generating weaving map D from the weaving map B to illustrate a jacquard device to select warp threads to raise.

Wherein, the order of steps S230 and S240 can be changed.

Figure 15:
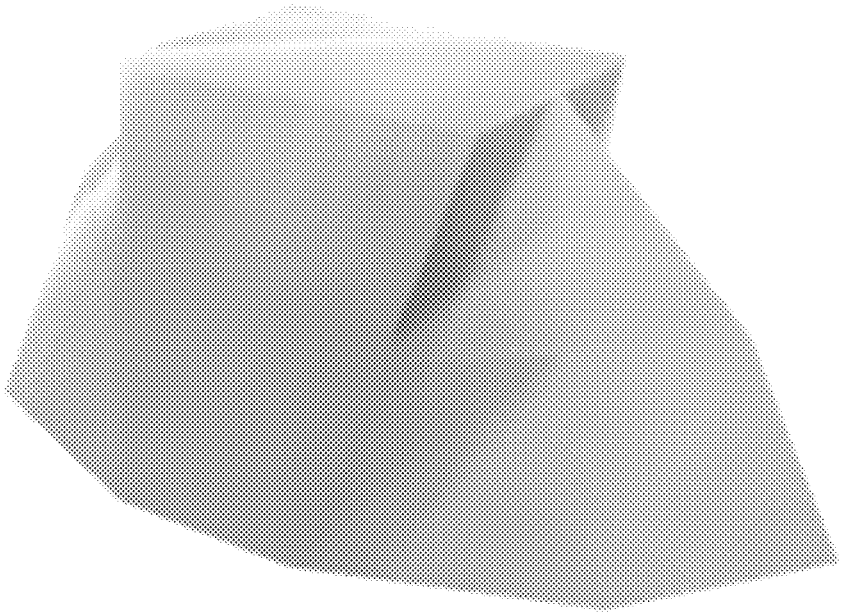
FIG. 15 illustrates a diagram for an embodiment of a desired three-dimensional object.

In an embodiment, a desired three-dimensional object shown in FIG. 15 is rebuilt into a three-dimensional surface mesh by Step S100. FIGS. 16-19, four weaving maps generated during the whole transformation process describe different states, namely weaving map A-D.

Figure 16:
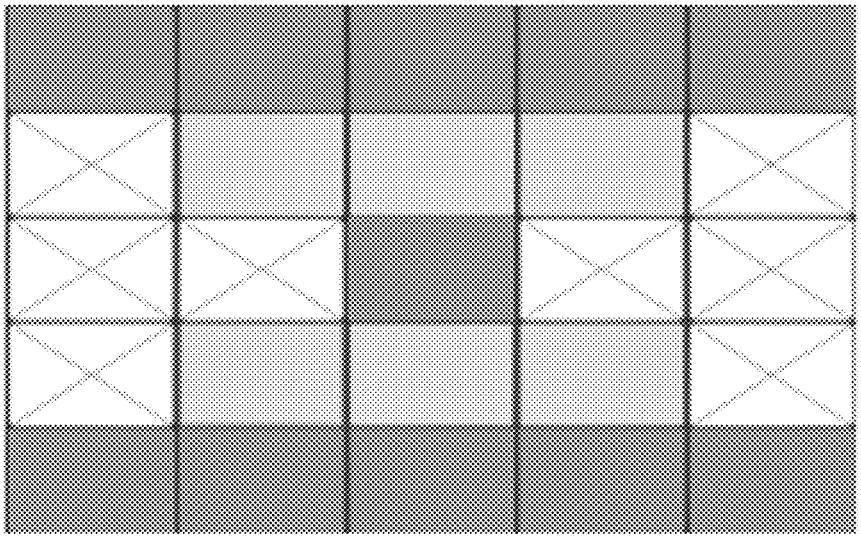
FIG. 16 illustrates a diagram for weaving map A of the desired three-dimensional object shown in FIG. 15, according to an embodiment of the present disclosure.
Figure 17:
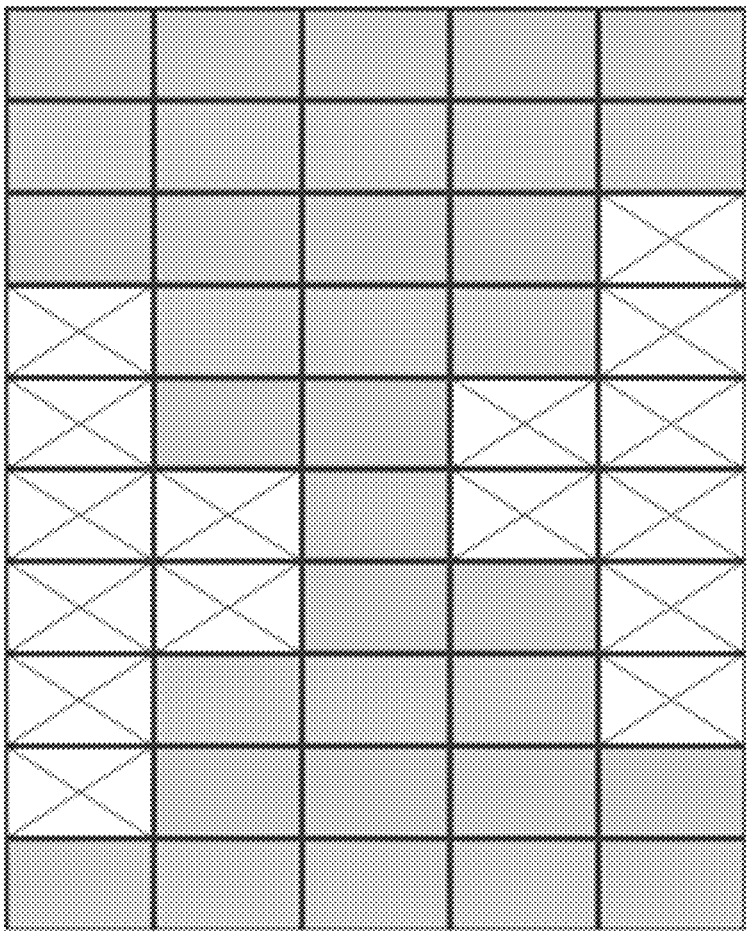
FIG. 17 illustrates a diagram for weaving map B of the desired three-dimensional object shown in FIG. 15, according to an embodiment of the present disclosure.

Referring to FIG. 16, in the step of S210, the three-dimensional surface mesh is decomposed into a two-dimensional weaving map A. Valid stitches are marked in gray, and invalid grids are marked with a cross. The hill-like 3D surface of the three-dimensional surface mesh can be expanded into a plane by cutting the sides of the surface. The plain surface can be converted to a grid known as weaving map A according to the size of the weaving unit.

Referring to FIG. 1.7, in the step of S220, by considering the continuity in the weaving process, each row of the weaving map A is divided into two rows and keeps the continuity to obtain a weaving map B. To keep the between-row continuity for the whole weaving map, the rows in weaving map A are firstly doubled, then add or remove grids at corners to form a new map called weaving map B. The direction of the weft thread is right for odd rows while it is left for even rows.

Referring to FIG. 18, in an embodiment, the step of S230 comprises:

transferring the weaving map B from bottom to top by taking last row as a reference; a value W stands for state for each grid in the weaving map C, W=1 represents filled state, W<1 represents empty state; if corresponding grid in the weaving map B is empty, a grid in the weaving map C will be empty and W is minus 1; if grid in reference row is empty, fabric will shrink to vanish gap produced by an empty grid which will be conducted after adjustment of warp threads length; S represents a length of shrink, S=1-W, and all value of grid in same row pulse S.

Weaving map C is generated from weaving map B to illustrate the feed rate of responding to the step motor 321 in the roller matrix 300 during the weaving process. The stitches in grey are valid (+1) while other stitches are invalid with a corresponding negative value.

The roller matrix 300 is mainly responsible to control the length of the warp threads for the operation of shrinking the plain fabric to form a 3D surface during the weaving process according to the weaving map C, which is developed based on the weaving map B. The transformation process in the weaving map B is from bottom to top and there is a value W standing for the state for each grid in the weaving map C, namely filled (where W=1) and empty state (where W<1). For each row in the weaving map C, we take the last row as a reference, normally, all grids in the first row are filled (W=1). If the corresponding grid in the weaving map B is empty the grid will be empty and W=W−1; If the corresponding grid in the weaving map B is filled and the grid in the reference row is filled, the grid will be filled too; instead, if the grid in reference row is empty, the fabric will shrink to vanish the gap produced by the empty grid which will be conducted after the adjustment of the warp threads length. The length of shrink S is decided by the difference between 1 and W (S=1−W). The operation of shrink is conducted by the weaving device 200 and all the values of the grid in the same row pulse S. In this way, the weaving map C is generated to control the length of the warp threads through the roller matrix 300.

In a specific embodiment, we will start from the bottom row at weaving map B and process one row at a time. For all columns, the initial value of $W_i$ is equal to 1, when we process the first row in weaving map B, there are only valid stitches, so the value of W keeps 1 and all stitches of the first row in weaving map C is colored because their W is positive. When we weave the second row, we find that there is one invalid stitch on the left side and the $W_0$ is 1, so the value of $W_0$ will be minus 1 to 0, and the stitch is empty without color, which means the column is empty and the length of the empty stitch is recorded by $W_i$. So repeat to the sixth row, now the W is an array of [−3, −1, 1, 0, −2] as shown in FIG. 18, and the sixth row in the weaving map B is shown as [0, 1, 1, 0, 0] (1 means valid stitch, 0 means invalid). We find that the second stitch of weaving map B is valid but $W_1$ is negative as −1, which means we need to "eliminate" the empty stitches by shortening the warp thread. The stretched length is equal to $(1-W_i)$ (unit length) and the $W_i$ will add a value S to 1 (for this time S is equal to 2). This process is global for all columns except the column whose $W_i$ is 1 and the corresponding stitch in weaving map B is valid. So the array W now becomes [−1, 1, 1, 2, 0], but we still need to calculate the individual empty stitches for each other column. That means if the corresponding stitch in weaving map B is invalid, we need to minus 1 for $W_i$. So, finally, we get a new array W as [−2, 1, 1, 1, −1] as shown in the sixth row in weaving map C.

Figure 19:
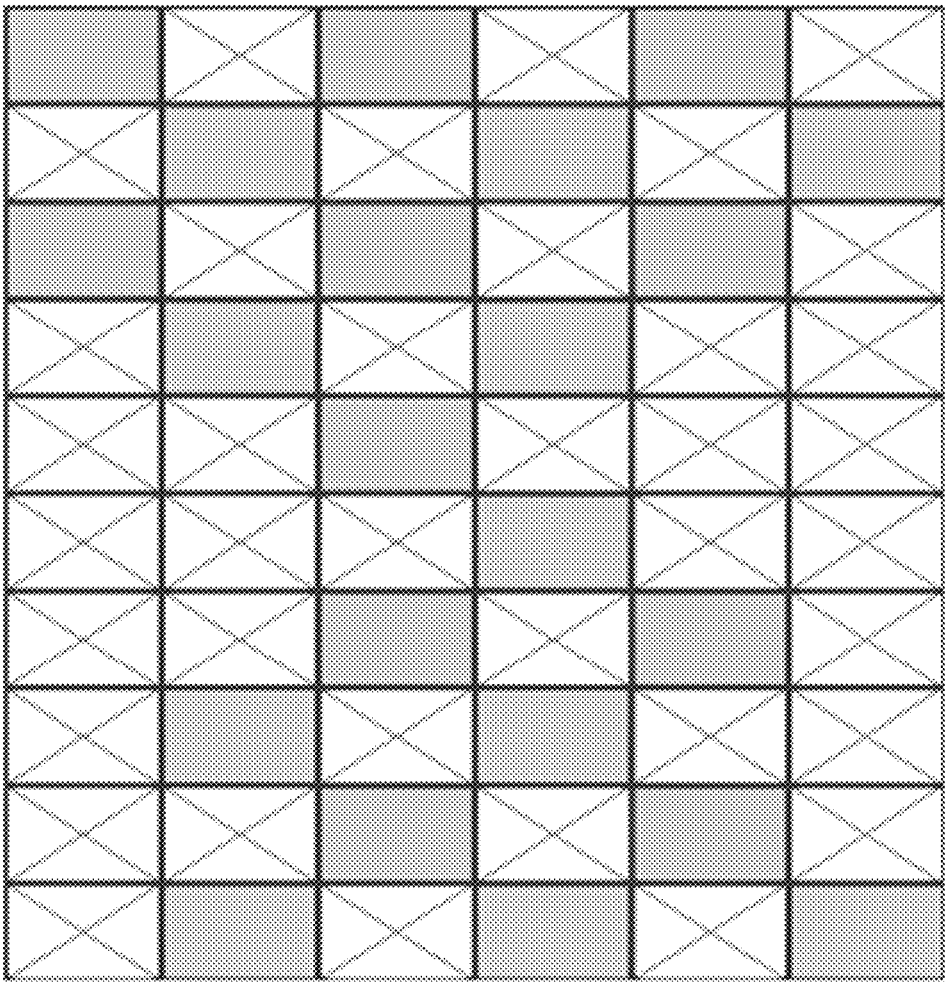
FIG. 19 illustrates a diagram for weaving map D of the desired three-dimensional object shown in FIG. 15, according to an embodiment of the present disclosure.
Figure 20:
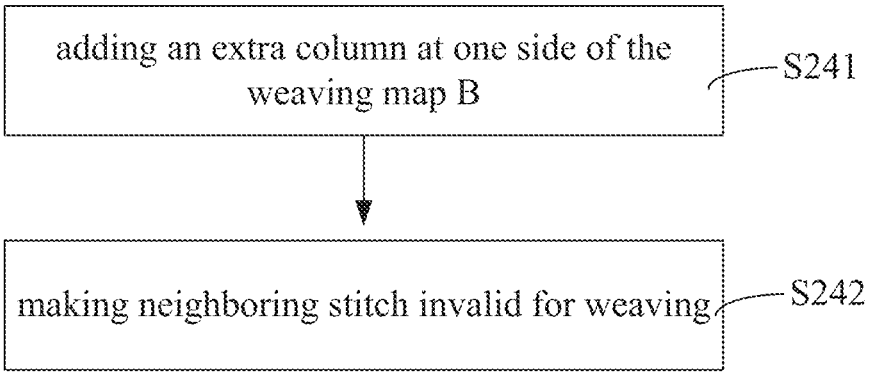
FIG. 20 illustrates a flowchart for an embodiment of step S240 of the control command generation method shown in FIG. 14.

Referring to FIGS. 19-20, in an embodiment, the step of S240 comprises:

S241: adding an extra column at one side of the weaving map B, and

S242: making neighboring stitch invalid for weaving.

Weaving map D is generated from weaving map B by adding an extra column on the right side and making the neighboring stitch invalid for weaving. The weaving map D is developed for the jacquard device 100 to correctly select warp threads to raise. Because a column corresponds to two neighboring warp threads and one of the neighboring warp threads for a valid grid should raise to form a shed while both of the neighboring warp threads for an invalid grid should lower, there is one more column in the weaving map D and each column corresponds to a warp thread. For the valid grid, there is one of the neighboring warp threads raise while for the invalid grid, both of the neighboring warp threads lower when converting the weaving map B to weaving map D.

Figure 21:
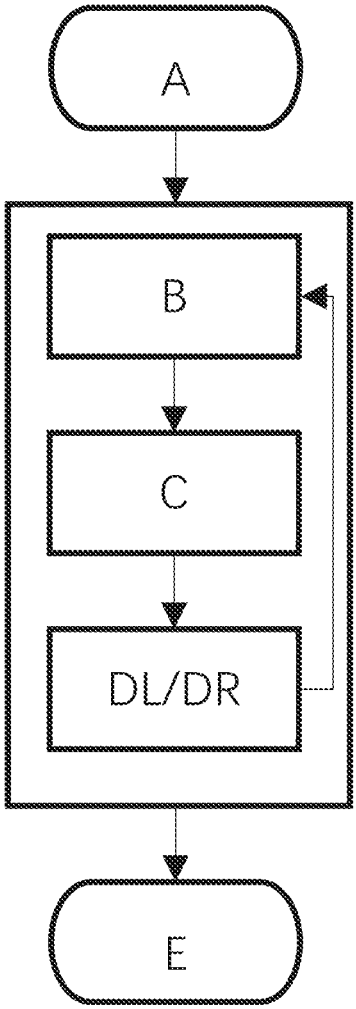
FIG. 21 illustrates a logic diagram for an embodiment of a control command of the control command generation method shown in FIG. 14.

In some embodiments, referring to FIG. 21, in the step of S300, the control command can comprise an initial command A to move parts of the weaving device 200 to pre-set position, a roller command B to control the roller matrix 300 according to the weaving map C, a jacquard command C to control the jacquard device 100 according to the weaving map D, a weaving command D to control the weaving device to carry a weft thread into a shed formed by the jacquard device and weave the weft thread on warp threads, and an ending command E to control the roller matrix release warp threads for a pre-set length.

Generally, in an embodiment, during the whole weaving process, command A and command E only appear once to initialize and finish the weaving process. When command A is sent to the system 10, all the parts will move back to the pre-set position for the following weaving process. When command E is sent to the weaving device 200, the roller matrix 300 will release warp threads for around 100 mm and the woven fabric move out of the collection apparatus 260 for a user to collect.

In some embodiments, referring to FIG. 22, the step of S300 comprises the following steps: generating roller command B to control the roller matrix 300 according to the weaving map C; the roller command B comprises an identification bit and data sets in groups of identification numbers; number of the data sets is equal to number of warp threads; the identification numbers of each data set comprise a binary bit stands and decimal bits; 2 characters of binary data bits in the identification numbers, respectively, represent sending warp thread and collect the warp thread; decimal bits in the identification numbers represent length to lengthen or shorten.

In a specific embodiment, the command B consists of two parts, namely an identification byte "B" and several data sets in groups of 4 numbers "1006 . . . ". The number of the data sets is as same as the number of warp threads to collect or send the warp threads. For each data set, the first binary bit means to send (1) or collect (0) and the rest 3 decimal bits indicate how long to lengthen or shorten. When command B is sent to the system 10, the corresponding rotate unit will release the warp thread or tighten it to control the length of the warp threads.

In some embodiments, the step of S300 comprises the following steps: generating jacquard command C to control the jacquard device 100 according to the weaving map D; number of the binary data bits is equal to number of warp threads; the jacquard command comprises an identification bit and binary data bits, 2 characters of binary data bits in the jacquard command, respectively, represent raising the heddles 120 of the jacquard device 100 and keeping the heddles 120 down.

In a specific embodiment, the command C consists of two parts, namely an identification bit "C" and several binary data bits "0110101 . . . ". The number of binary data is as same as the number of warp threads to selectively raise the heddles 120 to form the shed for the shuttle to travel. When command C is sent to the system 10, the system 10 will raise the heddles 120 whose corresponding data bit is "1" while others keep down.

Figure 23:
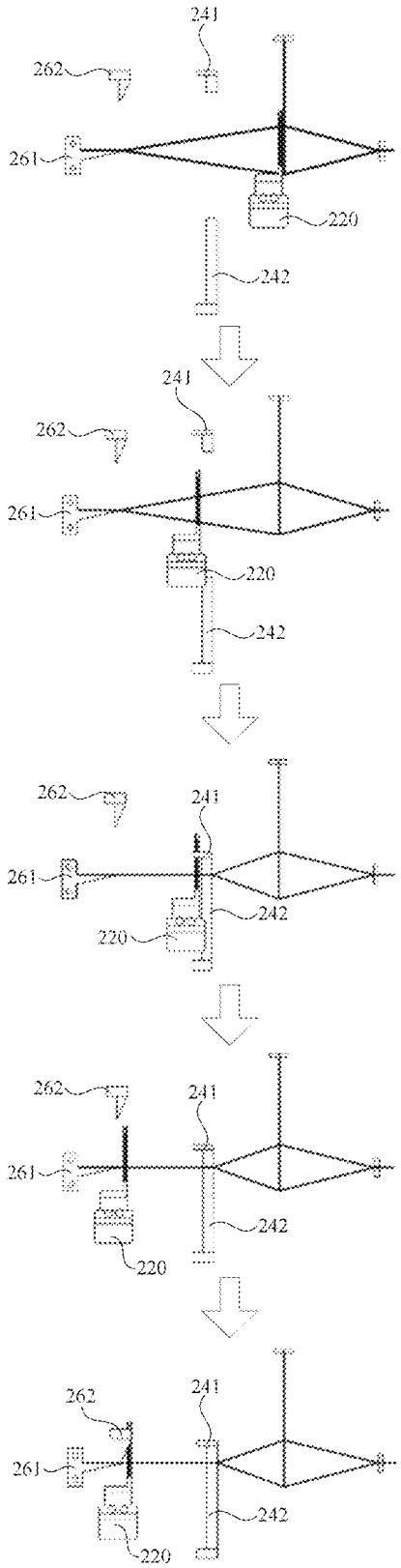
FIG. 23 illustrates an abridged general view for the working process of the system for three-dimensional surface weaving, according to an embodiment of the present disclosure.

There are two commands for command D, namely commands DR and DL. The only difference of them is that command DL means shuttle moves from right to left while command DR means shuttle moves from left to right. Referring to FIG. 23, when command D is sent to the system, the shuttle moves to another side to place the weft thread through the shed, then the reed 220 moves to the front of the gate 240, and the gate 240 closes to keep the warp threads at the same height. After that, the passages on the reed 220 close to clamp the warp threads before the reed 220 moves to the collection apparatus 260. When the reed 220 reaches the collection apparatus 260, the clamping piece clamps the finished fabric, and the passages on the reed 220 open to release the warp threads so that the warp threads keep it as it is when the reed 220 moves back to the original position.

Figure 24:
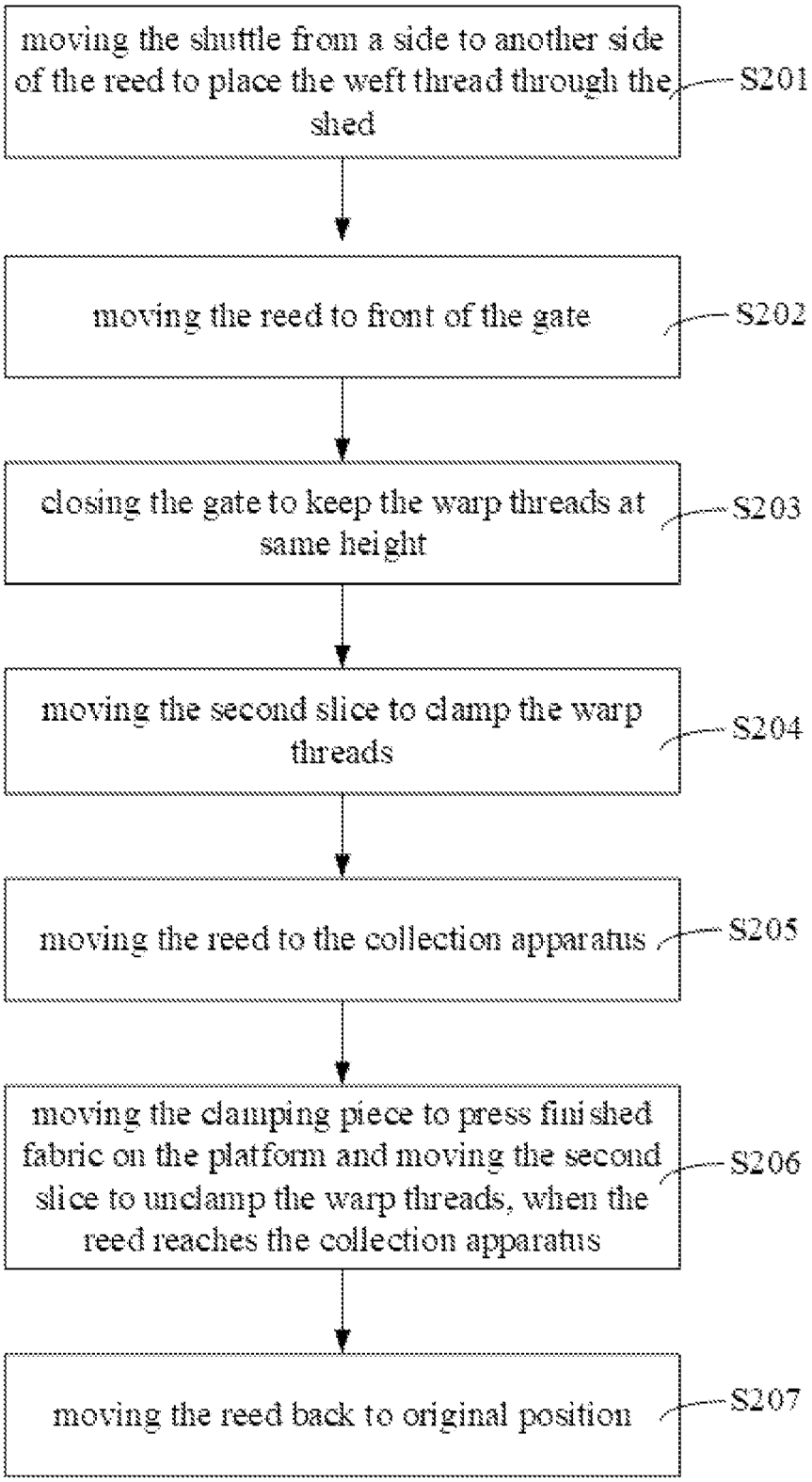
FIG. 24 illustrates a flowchart for an embodiment of the weaving device performing steps controlled by the weaving command generated by the control command generation method shown in FIG. 14.

Referring to FIG. 24, the weaving command is configured to control the weaving device to perform the following steps:

S201: moving the shuttle from one side to another side of the reed 220 to place the weft thread through the shed;

S202: moving the reed 220 to front of the gate 240;

S203: closing the gate 240 to keep the warp threads at same height;

S204: moving the second slice 222 to clamp the warp threads;

S205: moving the reed 220 to the collection apparatus 260;

S206: moving the clamping piece 262 to press finished fabric on the platform 261 and moving the second slice 222 to unclamp the warp threads, when the reed 220 reaches the collection apparatus 260; and S207: moving the reed 220 back to original position.

Figure 25:
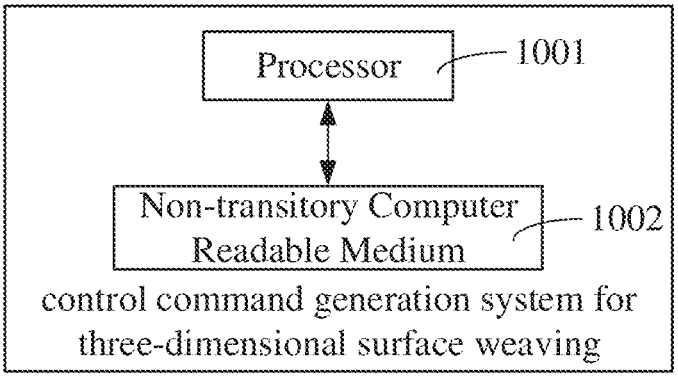
FIG. 25 illustrates a diagram for a control command generation system for e-dimensional surface weaving, according to an embodiment of the present disclosure.

Referring to FIG. 25, a control command generation system for three-dimensional surface weaving comprises a processor 1001 and a non-transitory computer readable medium 1002 connected to the processor 1001 and having stored thereon instructions for causing the processor 1001 to perform the steps of S100 to S300.

The technical features in the foregoing embodiments may be randomly combined. For concise description, not all possible combinations of the technical features in the embodiment are described. However, provided that combinations of the technical features do not conflict with each other, the combinations of the technical features are considered as falling within the scope recorded in this specification.

The foregoing embodiments only describe several implementations of the disclosure, which are described specifically and in detail, and therefore cannot be construed as a limitation to the patent scope of the disclosure. It should be noted that, a person of ordinary skill in the art may further make variations and improvements without departing from the ideas of the disclosure, which all fall within the protection scope of the disclosure. Therefore, the protection scope of the disclosure is subject to the protection scope of the appended claims.

What is claimed is:

1. A control command generation method for three-dimensional surface weaving, the method comprising steps of:

rebuilding a desired three-dimensional object into a three-dimensional surface mesh;

converting the three-dimensional surface mesh into readable weaving information; and generating control commands from the readable weaving information to instruct a three-dimensional surface weaving system;

wherein the step of rebuilding a desired three-dimensional object into a three-dimensional surface mesh comprises:

getting the three-dimensional surface mesh with uniform units over a surface of the desired three-dimensional object; a length of each unit is equal to a gap between neighboring warp threads, a width of each unit is equal to a gap between neighboring weft threads.

2. The control command generation method of claim 1, wherein shape of the unit is a rectangle, triangle, or parallelogram.

3. The control command generation method of claim 1, wherein the step of converting the three-dimensional surface mesh into readable weaving information comprises:

decomposing the three-dimensional surface mesh into a two-dimensional weaving map A;

doubling rows of the weaving map A and then keeping continuity by adding or removing grids at corners to form a weaving map B;

generating weaving map C from the weaving map B to illustrate feed rate of warp threads; and generating weaving map D from the weaving map B to illustrate a jacquard device to select warp threads to raise.

4. The control command generation method of claim 3, wherein the step of generating weaving map C from the weaving map B to illustrate feed rate of warp threads comprises: transferring the weaving map B from bottom to top by taking last row as a reference; a value W stands for state for each grid in the weaving map C, W=1 represents filled state, W<1 represents empty state; if corresponding grid in the weaving map B is empty, grid in the weaving map C will be empty and W is minus 1; if grid in reference row is empty, fabric will shrink to vanish gap produced by an empty grid which will be conducted after adjustment of warp threads length; S represents a length of shrink, S=1−W, and all value of grid in same row pulse S.

5. The control command generation method of claim 3, wherein the step of generating weaving map D from the weaving map B to illustrate a jacquard device to select warp threads to raise comprises:

adding an extra column at one side of the weaving map B, and making neighboring stitch invalid for weaving.

6. The control command generation method of claim 1, wherein the step of generating control commands from the readable weaving information to instruct a three-dimensional surface weaving system comprises:

generating a roller command to control a roller matrix according to the weaving map C; the roller command comprises an identification bit and data sets in groups of identification numbers; number of the data sets is equal to number of warp threads; the identification numbers of each data set comprise a binary bit stands and decimal bits; 2 characters of binary data bits in the identification numbers, respectively, represent sending warp thread and collect the warp thread; decimal bits in the identification numbers represent length to lengthen or shorten.

7. The control command generation method of claim 1, wherein the step of generating control commands from the readable weaving information to instruct a three-dimensional surface weaving system comprises:

generating a jacquard command to control a jacquard device according to the weaving map D; number of the binary data bits is equal to number of warp threads; the jacquard command comprises an identification bit and binary data bits, 2 characters of binary data bits in the jacquard command, respectively, represent raising heddles of the jacquard device and keeping the heddles down.

8. The control command generation method of claim 1, wherein the control command comprises an initial command to move parts of a weaving device to pre-set position;

a roller command to control a roller matrix according to the weaving map C;

a jacquard command to control a jacquard device according to the weaving map D;

a weaving command to control the weaving device to carry a weft thread into a shed formed by the jacquard device and weave the weft thread on warp threads; and an ending command to control the roller matrix release warp threads for a pre-set length.

9. The control command generation method of claim 8, wherein the weaving device includes a reed, a shuttle movable along the reed and configured to carry the weft thread, a gate located in middle of the weaving device, and a collection apparatus; the reed includes a first slice, a second slice, a third slice and a basement; the first slice and the third slice are fixed on the basement; the second slice is placed between the first slice and the third slice, and the second slice is movable to clamp or unclamp the warp threads; the gate is configured to open to let the reed pass or close to make the warp threads at same height; the collection apparatus includes of a platform and a movable clamping piece, the clamping piece is configured to press finished fabric on the platform;

the weaving command is configured to control the weaving device to perform the following steps:

moving the shuttle from one side to another side of the reed to place the weft thread through the shed;

moving the reed to front of the gate;

closing the gate to keep the warp threads at same height;

moving the second slice to clamp the warp threads;

moving the reed to the collection apparatus;

moving the clamping piece to press finished fabric on the platform and moving the second slice to unclamp the warp threads, when the reed reaches the collection apparatus; and moving the reed back to original position.

10. A control command generation system for three-dimensional surface weaving comprising:

a processor; and a non-transitory computer readable medium connected to the processor and having stored thereon instructions for causing the processor to:

rebuild a desired three-dimensional object into a three-dimensional surface mesh;

convert the three-dimensional surface mesh into readable weaving information; and generate control commands from the readable weaving information to instruct a three-dimensional surface weaving system;

wherein the step of rebuilding a desired three-dimensional object into a three-dimensional surface mesh comprises:

getting the three-dimensional surface mesh with uniform units over a surface of the desired three-dimensional object; a length of each unit is equal to a gap between neighboring warp threads, a width of each unit is equal to a gap between neighboring weft threads.

* * * * *